United States Patent [19]

Heinz

[11] 4,324,346

[45] Apr. 13, 1982

[54] DEVICE FOR THE TRANSFER OF A COIL TUBE

[75] Inventor: Kamp Heinz, Wegberg, Fed. Rep. of Germany

[73] Assignee: W. Schlafhorst & Co., Monchen-Gladbach, Fed. Rep. of Germany

[21] Appl. No.: 130,214

[22] Filed: Mar. 14, 1980

[30] Foreign Application Priority Data

Mar. 15, 1979 [DE] Fed. Rep. of Germany ..... 2910091

[51] Int. Cl.[3] ..... B23Q 7/08

[52] U.S. Cl. ..... 221/171; 221/211

[58] Field of Search ..... 221/171, 211, 261, 172, 221/278; 406/151-153

[56] References Cited

U.S. PATENT DOCUMENTS 2,445,713 4/1943 Glassner ..... 221/211

3,198,581 8/1965 Gamberini ..... 406/151 X

FOREIGN PATENT DOCUMENTS 1176290 11/1958 France ..... 221/171

*Primary Examiner*—Stanley H. Tollberg

*Attorney, Agent, or Firm*—Herbert L. Lerner

[57] ABSTRACT

Device for the controlled transfer of a coil tube from a coil supplying device to a pickup device, including a chute and a device for applying underpressure to a large area of the long side of the coil tube to transport the coil tube through the chute.

6 Claims, 12 Drawing Figures

FIG. 3
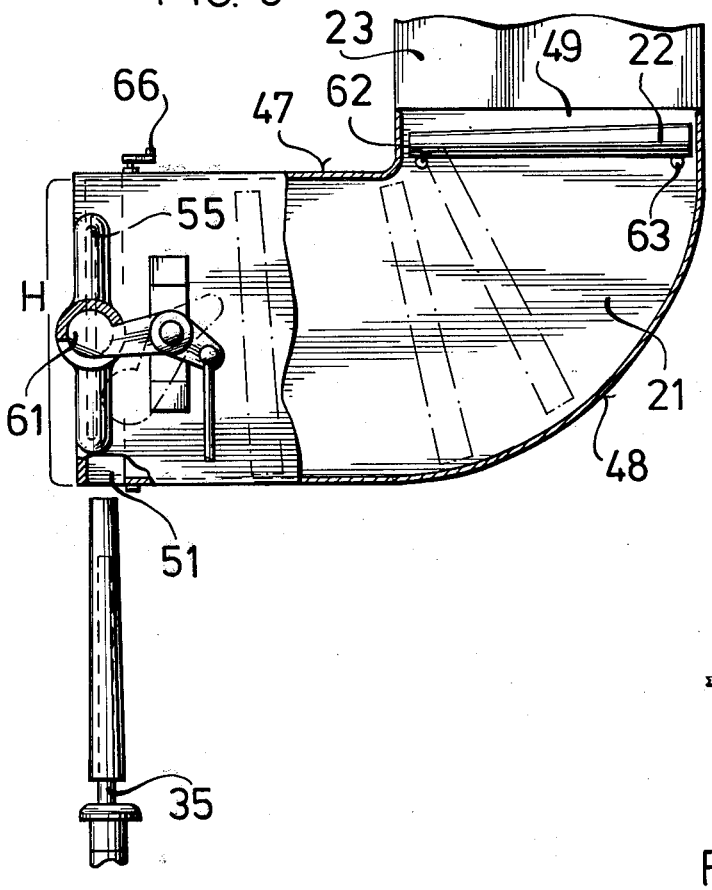
FIG. 5
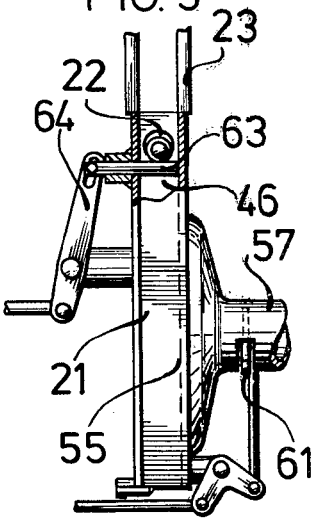
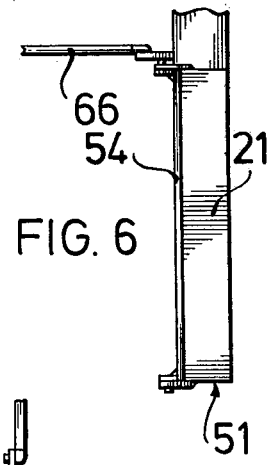
FIG. 6
FIG. 4
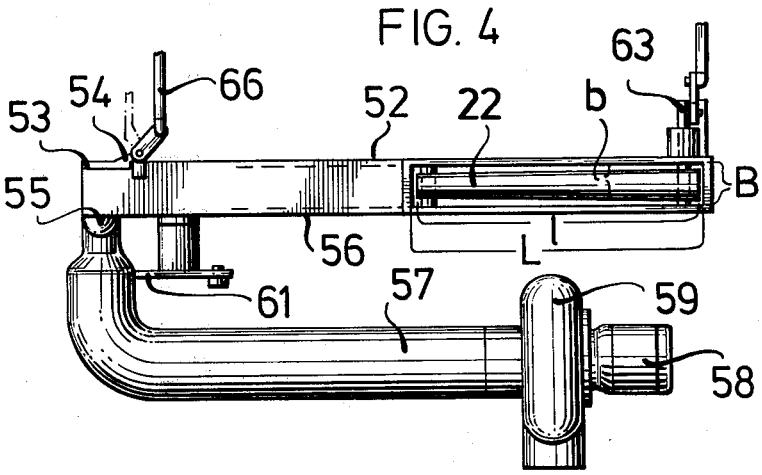

FIG. 9
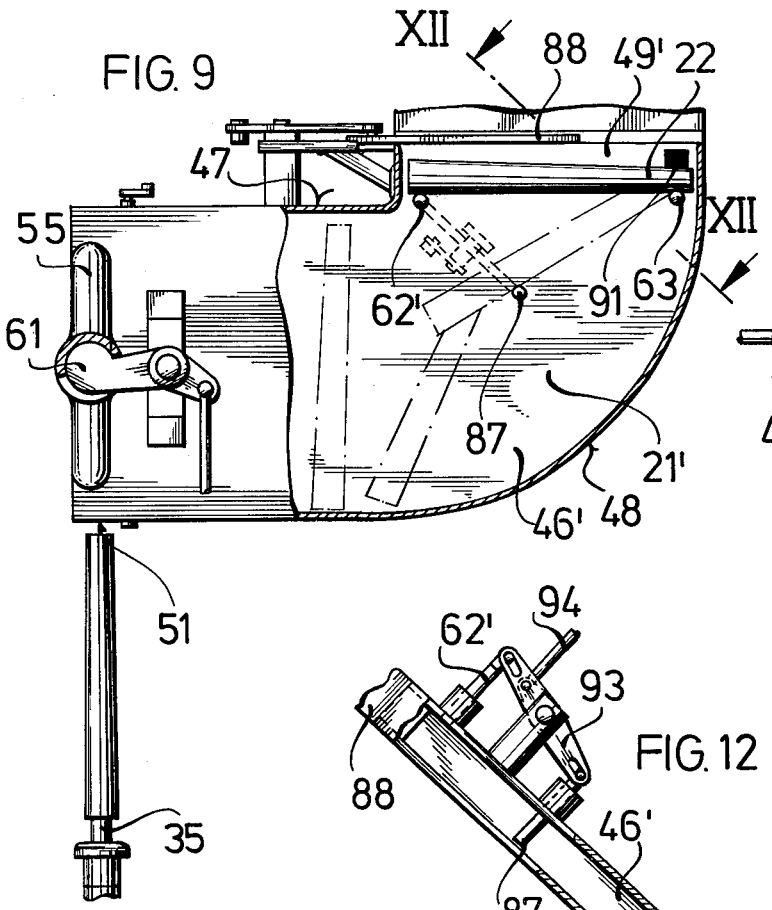
FIG. 11
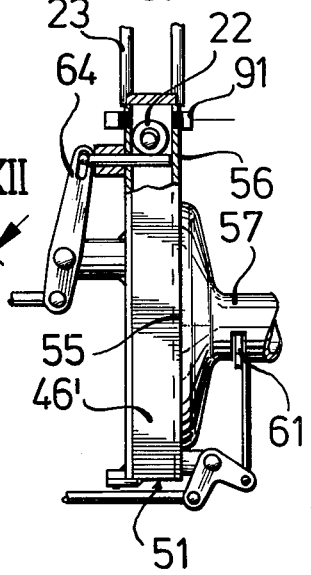
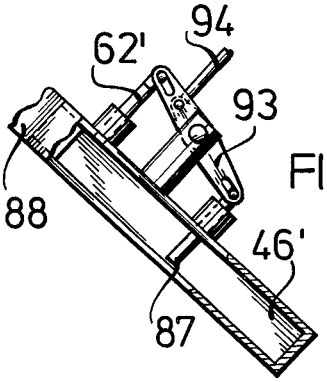
FIG. 12
FIG. 10
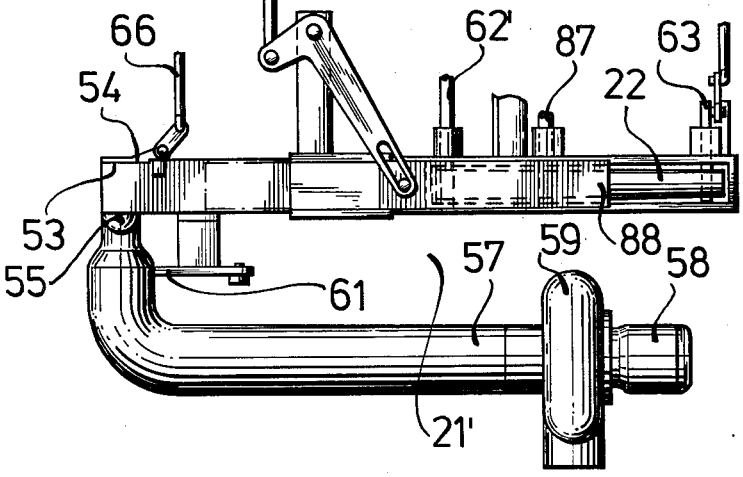

DEVICE FOR THE TRANSFER OF A COIL TUBE

The invention relates to a device for the controlled transfer of a coil tube from a hopper to a pickup device. Such devices are used, for example, to load a textile machine with various coil tubes. The term "coil tube" refers to empty, wound or partly wound coil tubes, but primarily to empty coil sleeves or cores. The coil tubes may be of cylindrical or tapered shape. A hopper is understood to be a supply reservoir, a supply magazine, a conveyor belt carrying and feeding in the coil tubes, or the like.

Known devices for the transfer of a coil tube from a hopper to a pickup device, such as for loading a spinning machine with individual conical coil tubes, have a multiplicity of mechanical parts interacting in a complicated manner, for which reason they work slowly and are trouble-prone. In other known devices, gravity is primarily utilized to transport the coil tubes. Therefore, their transporting speed is very limited. Moreover, the transport also depends on the weight and air resistance of the individual coil tubes. The upshot is slow and irregular operation.

It is accordingly an object of the invention to provide a device for the transfer of a coil tube, which overcomes the hereinafore-mentioned disadvantages of the heretofore known devices of this general type, and to accelerate the controlled transfer of a coil tube from a magazine device to a forwarding device and to make it functionally reliable.

With the foregoing and other objects in view there is provided, in accordance with the invention, a device for the controlled transfer of a coil tube from a coil supplying device such as a hopper to a pickup device, comprising a chute and means for applying underpressure to a large area of the long side or the length of the coil tube to transport the coil tube through the chute.

In accordance with another feature of the invention, the chute has an inner cross-sectional area with a length and a width which are greater than the respective length and width of the coil tube, the chute having narrow sides which are curved through an angle of substantially 90°, and the chute having an upper end with an at least substantially horizontal inlet opening formed therein and a lower end with an outlet opening formed therein, and the underpressure applying means includes a suction nozzle controllably acted upon by the underpressure disposed in vicinity of the outlet opening for the coil tube.

In accordance with a further feature of the invention, the narrow sides of the chute are an upper and a lower narrow side, the outlet opening being formed in the lower narrow side below the suction nozzle.

In accordance with an added feature of the invention, there is provided a controllable coil tube feeding device disposed at the inlet opening.

In accordance with an additional feature of the invention, the coil tube feeding device includes two supporting elements projecting into the chute, at least one of the supporting elements being controllably retractable from the chute.

Cylindrical coil tubes or tip-oriented conical coil tubes can be forwarded by the hereinafore-described device. If the hopper contains conical coil tubes which are not tip-oriented, in accordance with yet another feature of the invention, there is provided a controllable stop for the coil tube disposed substantially in the center of the chute below the inlet opening, and a controllable slide disposed partly above the inlet opening for closing off the inlet opening.

In accordance with yet a further feature of the invention, there is provided a shut-off valve for the underpressure supplied to the suction nozzle being disposed in the suction nozzle or in an underpressure line leading to the nozzle, the shut-off valve having a controllable drive, and a further controllable drive for actuating at least one of the coil tube feeding device, the supporting elements, the stop and the slide.

In accordance with yet an added feature of the invention, there is provided a control unit and operative connections connected from the control unit to the further controllable drive.

In accordance with yet an additional feature of the invention, the coil tube feeding device includes a coil tube sensing device, and an operating connection from the sensing device to the control unit.

In accordance with a concomitant feature of the invention, the outlet opening is formed in the bottom of the chute and the chute has another side having a wall with a second closeable outlet opening formed therein, the second outlet opening being merged into the first-mentioned outlet opening when open and having a height which is at least as great as the length of the coil tube. This last-described embodiment of the invention is particularly well suited for the successive placement of individual tapered coil tubes on the spindles of a spinning machine. The equipment required therefor is movable and carries a supply of conical coil tubes.

Other features which are considered as characteristic for the invention are set forth in the appended claims.

Although the invention is illustrated and described herein as embodied in a device for the transfer of a coil tube, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 3 is a partial view of the device of FIG. 1;

FIG. 4 is a partial top plan view of the device of FIG. 1;

FIGS. 5 and 6 show fractional views of the device of FIG. 1;

FIGS. 9 and 10 are a partial view and a partial top plan view, respectively, of FIG. 7; and FIGS. 11 and 12 are views of details of the second embodiment of FIG. 7.

Figure 1:
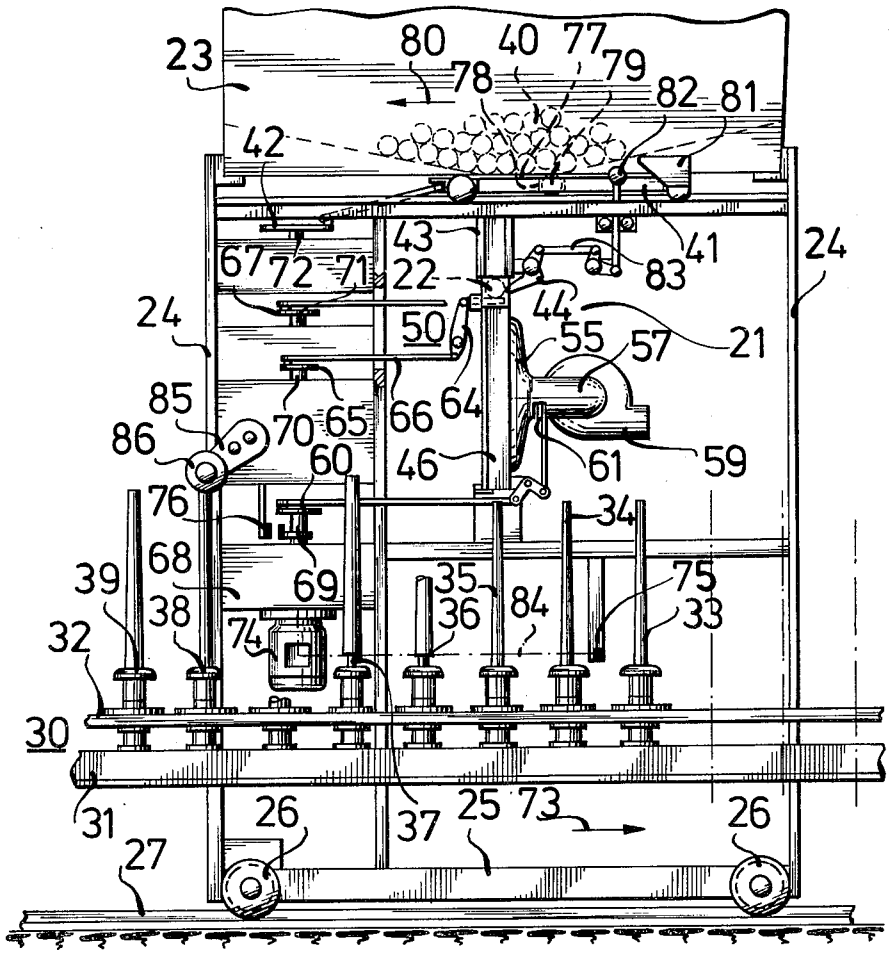
FIG. 1 is a diagrammatic fragmentary front elevational view of a first embodiment device according to the invention.
Figure 2:
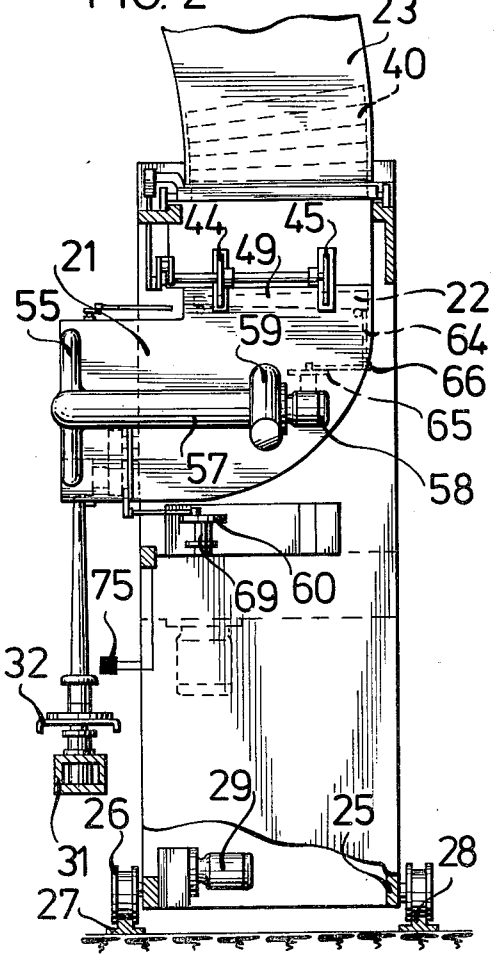
FIG. 2 is a side elevational view of FIG. 1.

Referring now to the figures of the drawing and first particularly to the first embodiment of the invention, FIGS. 1 and 2 show that the device 21 for the controlled transfer of a coil tube, e.g. the coil tube 22, is combined with a hopper or dispensing device 23. The drawings show a machine frame 24 with an undercarriage 25 equipped with wheels 26 which run on a track 27, 28. One of the wheels 26 is driven by an undercarriage motor 29.

The entire device can travel alongside a ring spinning machine 30 or pickup device, of which one spindle bank 31, a ring bank 32 and spindles 33 to 39, are visible.

The hopper 23 has a container containing tip-oriented, tapered coil tubes 40. At the bottom of the container is a separator comprising a movable slide 41 with a drive 42 constructed as a crank drive. In one full turn of the crank drive 42 the slide 41 moves back and forth once, letting one coil tube drop into a receiving chute 43 in which the coil tube is then caught by controllable catch hooks 44, 45.

The actual transfer device 21 is disposed below the receiving chute 43. It has a chute 46, the inside cross-sectional area of which is somewhat greater in length L than the length l of the coil tube 22 and somewhat greater in width B than the width b of the coil tube, as may be seen from FIG. 4. As FIG. 3 shows in particular, the narrow sides 47, 48 of the chute 46 are curved through an angle of approximately 90 degrees. The inlet opening 49 of the chute 46 is at its upper end, and is horizontal.

One outlet opening 51 is located at the lower end of the chute 46, namely at its bottom. A second outlet opening 53 is disposed in the rear sidewall 52 of the chute 46. This outlet opening 53 can be closed by a flap 54 and, when open, it merges into the first outlet opening 51. The height H of the second outlet opening 53 is greater than the length l of the coil tube 22.

A suction nozzle 55, upon which a controlled underpressure can act, is provided in the vicinity of the outlet opening 51. This suction nozzle has a vertical slot which penetrates the front broadside 56 of the chute 46 and merges into an underpressure line 57. At the end of the underpressure line 57 an exhaustor 59 which is driven by an electric motor 58, is mounted. The heretofore mentioned first outlet opening 51 is located under the suction nozzle 55 in the lower narrow side 48 which, in the area of the outlet opening, simultaneously forms the lower bottom of the chute 46. In the vicinity of the suction nozzle 55 the underpressure line 57 has a shut-off valve 61 that is controllable by a drive 60.

A controllable coil tube feeding device 50 is disposed at the inlet opening 49. The device 50 has two supporting elements 62, 63 projecting into the chute 46. These two supporting elements are indicated in FIG. 3 of the drawing. Looking at the device 21 from the left as shown in FIG. 3 gives the view shown in FIG. 5. FIG. 5 represents the device 21 with its upper portion cut away so that the full length of the supporting element 63 is visible. By means of a two-armed lever 64, this supporting element 63 is controlled by a drive 65 shown in FIG. 1. The other supporting element 62 is not controllable and remains in place constantly. FIG. 6 shows the device 21 from the same side as FIG. 5. However, FIG. 6 only specifically shows the flap 54 and its operating rod 66. The drive 67 actuating the flap 54 is shown in FIG. 1.

It may also be seen from FIG. 1 that a control unit, designated with reference numeral 68 in its entirety, is present. The drives 60, 65, 67, and 42 are connected through operative connections 69, 70, 71, 72 to the control unit 68. The control unit 68 involves a sequential control device. It is permanently set for the following control sequence:

(a) Open the shut-off valve 61 and simultaneously close flap 54,
(b) retract the supporting element 63,
(c) re-extend the same supporting element 63,
(d) close the shut-off valve 61 and simultaneously open the flap 54.

In the embodiment example at hand, the ring spinning machine 30 itself acts as the pickup device; its spindles individually and successively accepting the surrendered coil tubes. For this purpose, the device 21 according to FIG. 1 travels alongside the spindles of the spinning machine in the direction of the arrow 73 at a constant rate of speed. The control unit 68 is driven by a stepping motor 74. This motor 74 is turned on by an optoelectronic spindle scanning device 75. Turning off the motor 74 is accomplished by the control unit 68 after the conclusion of the set control program. A stepless switch 76 is provided for this purpose. The drives 60, 65, 67, and 42 represent crank drives and the associated positive connections 69, 70, 71, and 72 are shafts so that the control unit 68 is essentially a settable gear transmission. The detailed function of such a gear transmission need not be discussed at this point.

The control of the slide 41 of the hopper 23 is synchronized with the control of the device 21. The slide 41 has a coil tube receptacle 78, large enough for one coil tube only. In the basic position shown in FIG. 1, this coil tube receptacle 78 is located below a bottom opening 77 of the hopper 23 and has already accepted a coil tube 79. When the drive 42 is actuated, the slide 41 is pulled in the direction of the arrow 80 until the coil tube receptacle 78 is located above the receiving chute 43 so that the coil tube drops into the receiving chute. The coil tube is caught in its fall by the catch hooks 44, 45 because a control wedge 81 has contacted a feeler roll 82 with the consequence that a linkage 83 swings the catch hooks under the receiving chute. Only when the slide 41 retracts into its initial position, do the catch hooks release the coil tube so that it can move onto the supporting elements 62, 63, as is the case with the coil tube 22 of the embodiment example.

The controlled transfer of a coil tube to the pickup device, in this case the ring spinning machine 30, proceeds as follows:

During the travel of the device 21 in the direction of arrow 73 the spindle sensing device 75 first detects the approach of the spindle. In the embodiment example according to FIG. 1 this is the spindle 33. Thereupon, the spindle sensing device 75 transmits an ON-command to the stepping motor 74 through the positive connection 84 so that the control unit 68 is actuated. The control unit 68 now initiates the following processes:

The drive 60 is set in operation, whereby the shut-off valve 61 is opened. Underpressure now prevails in the chute 46. At the same time, the drive 67 is also actuated, closing the flap 54. In addition, the drive 42 is actuated. Subsequently, the drive 65 is turned on with the consequence that the supporting element 63 is retracted from the chute 46. According to FIG. 3, the coil tube 22 now loses its support at its right end, and due to the effect of the underpressure, it arrives in front of the suction nozzle 55 very quickly. The intermediate positions of the coil tube are shown in dot-dash lines in FIG. 3.

In the meanwhile, the device 21 travels further in the direction of arrow 73. FIG. 1 still shows the preceding state. The spindle sensing device 75 has not yet approached the spindle 33. The spindle 35 happens to stand under the chute 46 which will release a coil tube in a moment. These remarks must precede the description of the remaining operating cycle.

After the supporting element 63 has been retracted and the coil tube 22 is on its way to the suction nozzle 55, the supporting element 63 is reinserted. When the catch hooks 44, 45 release the next coil tube 79 in the course of the functioning cycle described above, it accordingly remains in readiness, lying on the supporting elements 62, 63.

The shut-off valve 61 is now closed again by means of the drive 60. At the same time, the flap 54 is opened by means of the drive 67. The pulled-up coil tube 22 now loses its support and falls vertically downward onto the spindle 34 which has meanwhile arrived under the chute 46. The opened flap 54 sees to it that this fall is not impeded by the chute 46 which continues its travel. The starting position of all drives is thus reached again, and the stepping motor 74 is turned off by the switch 76. This rest position is maintained until the spindle sensing device 75 detects the approach to the next spindle.

In FIG. 1 there may also be seen a resiliently pivoted arm 85 with a roll 86. Both parts serve the purpose of pushing the already-applied coil tubes somewhat more firmly onto the spindles 37.

The second embodiment example of the invention according to FIGS. 7 to 12 differs from the first embodiment example in the details described below. Because of the deviations mentioned, the device for the controlled transfer of a coil tube is here designated as 21'.

Figure 7:
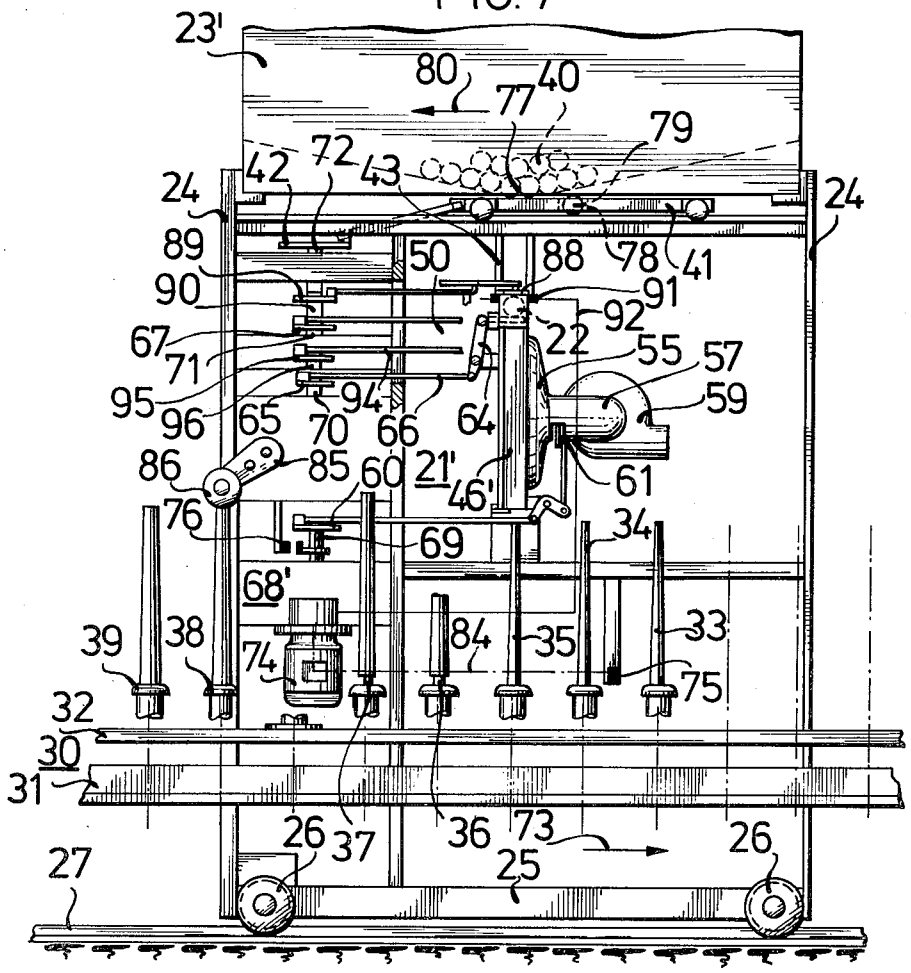
FIG. 7 is a diagrammatic front elevational view of a second embodiment of a device according to the invention.

FIG. 7 shows the device 21' in a front view, and

Figure 8:
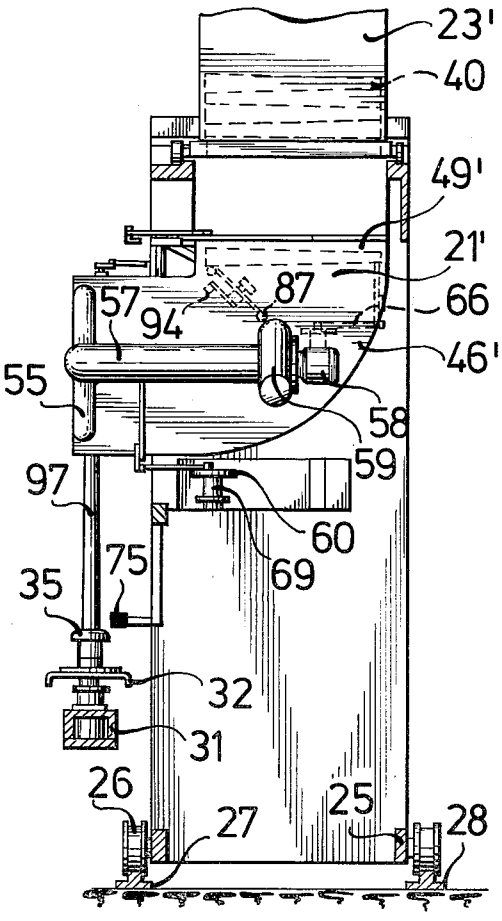
FIG. 8 is a side elevational view of FIG. 7.

FIG. 8 in a side view.

FIG. 9 shows the details of the chute, here marked 46'. p Looking from the left-hand side at the chute 46' shown in FIG. 9 gives the view shown in FIG. 11. Taking a section through the chute 46' along the line XII—XII and looking in the direction of the arrows gives the sectional view of FIG. 12.

FIG. 10 shows a top view of the chute 46' and of the essential components of the device 21'.

Deviating from the first embodiment example of the invention, a controllable stop 87 for the coil tube 22 is disposed below the inlet opening 49' approximately in the center of the chute in this second embodiment example. In addition, a controllable slide 88 which partly closes the inlet opening is provided above the inlet opening. The slide 88 is actuated by a drive 89 connected to the control unit 68' by a positive connection 90. The supply reservoir of the hopper 23 here contains tapered coil tubes which are not tip-oriented. Therefore, the position of the coil tube tip must be determined in each individual case, which is accomplished by a photo-electric coil tube sensing device 91 which has an operative connection 92 to the control unit 68'. The controlled catch hooks present in the first embodiment example are omitted here.

In this embodiment example, not only the supporting element 63, but also the supporting element 62' is controlled, alternately with the stop 87, as shown in particular in FIG. 12. A two-arm lever 93 is hinged to the supporting element 62' and the stop 87. This lever is actuated by a control rod 94 which is connected to a drive 95. The drive 95 is connected to the control unit 68' through an operative connection 96. The remaining components of the device 21' correspond to those of the device 21 so that a repetition of the appropriate description is unnecessary.

The control unit 68' is permanently set for the following sequence of functions:

(a) Open the shut-off valve 61 and simultaneously close the flap 54,
(b) selectively insert the stop 87, simultaneously,
(c) selectively retract one supporting element 62', 63,
(d) retract the stop 87,
(e) selectively reinsert the supporting element 62', 63,
(f) close the shut-off valve 61 and simultaneously open the flap 54,
(g) retract the slide 88,
(h) reinsert the slide 88.

At the same time, the control unit 68' also controls the slide 41 of the hopper 23'. The selection of the supporting elements or of the stop is made by the photoelectric coil tube sensing device 91 in accordance with the position of the coil tube tip.

FIG. 7 shows the device according to the invention at the moment when a coil tube, which is hidden here, is being retained by the suction nozzle 55 and will drop onto the spindle 35 a moment later. FIG. 8 shows that this coil tube 97 has already dropped onto the spindle 35. While the device 21' continues traveling in the direction of arrow 73, a short rest period sets in until the spindle sensing device 75 detects the approach of the spindle 33. At that moment the stepping motor 74 receives an ON-command, and the control unit 68' starts functioning. It actuates the drives 60 and 67. This opens the shut-off valve 61 and closes the flap 54. In the present embodiment example, the coil tube sensing device 91 has found that the tip of the coil tube 22 is above the supporting element 63. Therefore, the command to insert the stop 87 and at the same time retract the supporting element 62' goes to the control unit 68' through the operative connection 92. Had the coil tube 22 been positioned the other way, no special command would have gone to the control unit 68' via the operative connection 92, with the consequence that the supporting element 62' would then have stayed inserted while the supporting element 63 would have been retracted and the stop 87 would not have been inserted.

After the retraction of the supporting element 62' the coil tube 22 tips down onto the stop 87, is then grabbed by the air flow caused by the underpressure with the slide 88 closed, and is quickly transported in front of the suction nozzle 55. The various phases of this transport are shown in FIG. 9 in dot-dash lines. In the meanwhile, the stop 87 is retracted and the supporting element 62' is reinserted. As soon as this is done, the shut-off valve 61 is closed, causing the pulled-up coil tube 22 to drop onto the spindle 34 which is then located under the chute 46'. Simultaneously with the closing of the shut-off valve 61, the flap 54 is opened by means of the drive 65 in the present case as in the first embodiment example so that the transfer of the coil tube can take place unimpeded while the device 21' is traveling.

In the meantime, the slide 41 of the hopper 23' has also become activated and has dropped the coil tube 79 lying in the coil tube receptacle 78 into the receiving chute 43. Thereupon, the drive 89 retracts the slide 88, enabling the coil tube to fall down onto the supporting elements 62', 63. The slide 88 is then inserted again. The transfer cycle is now concluded.

In the embodiment examples chosen, the various drives involve crank drives, connected by linkages, levers, angular levers or the like, i.e. by simple machine elements, to the devices to be actuated, as the drawings show without further explanation. Optionally, other components may be used for this purpose as well.

The advantages achieved by the invention are, in particular, that the actual coil tube transport during the transfer of the coil tube takes place pneumatically, thereby assuring great operational reliability, a rapid sequence of functions and a long life of the device.

The invention is not limited to the embodiment examples shown and described. Other embodiments are also possible within the scope of the patent claims.

Optionally, the hopper may also involve a simple magazine container or a conveyor belt which feeds the coil tubes in, individually and successively. In other applications, the entire transfer device may also be stationary. The flap 54 may possibly be obviated then. The pickup device may alternatively be constructed in the form of a conveyor belt, for instance. The embodiment examples chosen are not to restrict the field of application of the invention to a spinning machine either.

There are claimed:

1. Device for the controlled transfer of a coil tube from a coil supplying device to a pickup device, comprising a chute, means for applying underpressure to a large area of the long side of the coil tube to transport the coil tube through said chute, said chute having an inner cross-sectional area with a length and a width which are greater than the respective length and width of the coil tube, said chute having narrow sides which are curved through an angle of substantially 90°, and said chute having an upper end with an at least substantially horizontal inlet opening formed therein and a lower end with an outlet opening formed therein, said underpressure applying means including a suction nozzle controllably acted upon by the underpressure disposed in vicinity of said outlet opening for the coil tube, a controllable coil tube feeding device disposed at said inlet opening, said coil tube feeding device including two supporting elements projecting into said chute, at least one of said supporting elements being controllably retractable from said chute, a controllable stop for the coil tube disposed substantially in the center of said chute below said inlet opening, and a controllable slide disposed partly above said inlet opening for closing off said inlet opening.

2. Device for the controlled transfer of a coil tube from a coil supplying device to a pickup device, comprising a chute, means for supplying underpressure to a large area of the long side of the coil tube to transport the coil tube through said chute, said chute having an inner cross-sectional area with a length and a width which are greater than the respective length and width of the coil tube, said chute having narrow sides which are curved through an angle of substantially 90°, and said chute having an upper end with an at least substantially horizontal inlet opening formed therein and a lower end with an outlet opening formed therein, said underpressure applying means including a suction nozzle controllably acted upon by the underpressure disposed in vicinity of said outlet opening for the coil tube, and said chute having another side having a wall with a second closeable outlet opening formed therein, said second outlet opening being merged into said first-mentioned outlet opening when open and having a height which is at least as great as the length of the coil tube.

3. Device according to claim 1 or 2, wherein said narrow sides of said chute are an upper and a lower narrow side, said outlet opening being formed in said lower narrow side below said suction nozzle.

4. Device according to claim 1, including a shut-off valve for the underpressure supplied to said suction nozzle, said shut-off valve having a controllable drive, and a further controllable drive for actuating at least one of said coil tube feeding device, said supporting elements, said stop and said slide.

5. Device according to claim 4, including a control unit and operative connections connected from said control unit to said further controllable drive.

6. Device according to claim 5, wherein said coil tube feeding device includes a coil tube sensing device, and an operative connection from said sensing device to said control unit.

* * * * *